US008999024B2

(12) United States Patent
Axinte et al.

(10) Patent No.: US 8,999,024 B2
(45) Date of Patent: Apr. 7, 2015

(54) SUPERABRASIVE CUTTING ELEMENT AND MANUFACTURING METHOD WITH HIGH DEGREE OF CONTROL OF DISTRIBUTION AND CRYSTALLOGRAPHIC ORIENTATION OF THE MICRO CUTTING EDGES

(75) Inventors: Dragos Axinte, Nottingham (GB); Paul Butler-Smith, Nottingham (GB); Mark Daine, Nottingham (GB)

(73) Assignee: The University of Nottingham, Nottingham (GB)

( * ) Notice: Subject to any disclaimer, the term of this patent is extended or adjusted under 35 U.S.C. 154(b) by 621 days.

(21) Appl. No.: 13/140,610

(22) PCT Filed: Dec. 18, 2009

(86) PCT No.: PCT/GB2009/002916

§ 371 (c)(1),
(2), (4) Date: Aug. 15, 2011

(87) PCT Pub. No.: WO2010/070294

PCT Pub. Date: Jun. 24, 2010

(65) Prior Publication Data

US 2011/0289855 A1 Dec. 1, 2011

(30) Foreign Application Priority Data

Dec. 18, 2008 (GB) ..... 0823086.4
Jul. 31, 2009 (GB) ..... 0913341.4

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***C09C 1/68*** | (2006.01) |
| ***B24D 99/00*** | (2010.01) |

(52) U.S. Cl.
CPC ..... *B24D 18/00* (2013.01); *B24D 99/00* (2013.01)

(58) Field of Classification Search
USPC ..... 51/307, 293, 308
See application file for complete search history.

(56) References Cited

U.S. PATENT DOCUMENTS

| | | | | |
|---|---|---|---|---|
| 5,453,106 | A * | 9/1995 | Roberts | 51/307 |
| 2006/0258276 | A1* | 11/2006 | Sung | 451/527 |

FOREIGN PATENT DOCUMENTS

| | | |
|---|---|---|
| EP | 0 358 526 | 3/1990 |
| EP | 0 657 250 | 6/1995 |
| EP | 0 776 732 | 6/1997 |
| EP | 0 945 222 | 9/1999 |
| WO | WO 02/053324 | 7/2002 |

* cited by examiner

*Primary Examiner* — James McDonough
(74) *Attorney, Agent, or Firm* — Nixon & Vanderhye P.C.

(57) ABSTRACT

An abrasive element comprises a body of crystalline abrasive material. The body has an array of cutting elements formed of crystalline abrasive material which projects from a surface of the body. The shape, size and form of the projections is controlled in the production process. The body may be a natural or synthetic crystal. The body may be a film formed by deposition. The body may be diamond or cubic boron nitride. The body may be monocrystalline or polycrystalline. The projections may be aligned along a crystallographic plane or planes.

15 Claims, 5 Drawing Sheets

SUPERABRASIVE CUTTING ELEMENT AND MANUFACTURING METHOD WITH HIGH DEGREE OF CONTROL OF DISTRIBUTION AND CRYSTALLOGRAPHIC ORIENTATION OF THE MICRO CUTTING EDGES

This application is the U.S. national phase of International Application No. PCT/GB2009/002916 filed 18 Dec. 2009 which designated the U.S. and claims priority to Great Britain Patent Application No. 0823086.4 filed Dec. 18, 2008 and Great Britain Patent Application No. 0913341.4 filed Jul. 31, 2009, the entire contents of each of which are hereby incorporated by reference.

The present invention relates to abrasive tools. Examples of the invention relate to abrasive tools which incorporate crystalline material, such as diamond or cubic boron nitride (cbn).

It has been proposed to manufacture abrasive tools, such as grinding and cutting tools, by mixing diamond or cbn crystals of selected size and characteristics into a prepared bond material. This forms a cutting matrix which is a mix of crystals and bond material and can be moulded into a desired profile. The matrix contains randomly orientated crystals at irregular locations. These protrude from the bond material to serve as the cutting elements.

In an alternative proposal for surface set superabrasive tools, diamond or cbn abrasive granules are typically sprinkled or packed onto the surface and anchored onto the tool form by a galvanic or a brazing process. The resulting monolayer of abrasive contains abrasive crystals at irregular locations and with random orientations.

During the use of such tools for abrasive operations (including cutting), a multiplicity of abrasive crystals contact the workpiece and effect the process of material removal. For any particular crystal, its location relative to neighbouring crystals and its orientation relative to the workpiece may neither be ideal for optimal performance.

In examples of one aspect of the present invention, there is provided an abrasive element comprising a body of crystalline abrasive material having an array of cutting elements formed as projections of the crystalline abrasive material at a surface of the body.

The term "projection" is here used to refer to a material formation which obtrudes or juts out from a body of material.

The cutting elements may be arranged as a regular array. A plurality of the cutting elements may form a line of cutting elements in the array. A plurality of the cutting elements may have at least one face or edge with the same orientation in each cutting element. Each of the plurality of cutting elements may have substantially the same shape. There may be a further plurality of cutting elements within the array, having a different form. There may be one or more further arrays of cutting elements formed as projections of the crystalline abrasive material at the or a surface of the body. At least some of the cutting elements within at least one of the arrays protrude from the surface by the same amount as each other.

At least some of the projections may be formed by removing material from the surface. Material may be removed along lines, to leave projections. Material may be removed along lines of a plurality of orientations. Material may be removed over areas, to leave projections. Material may be removed by multiple operations, and with the orientation of the body being changed between operations.

At least some of the projections may be parallelepipedal, prismatic, cylindrical, pyramidal or frustum in form. At least some of the projections may have planar tops, which may be parallel with or inclined relative to the surface of the body. At least some of the planar tops may be polygonal. At least some of the projections may have curved tops. The projections may have surfaces which meet the surface of the body at an obtuse or acute angle. The projections may have surfaces which meet at edges, at obtuse or acute angles. At least some of the cutting elements within at least one of the arrays protrude from the surface by the same amount as each other.

The array may include a line of projections aligned along a crystallographic plane. The array may include a group of projections which each have a face or edge along a crystallographic plane. The body may have a plurality of faces in which arrays of cutting elements are formed as aforesaid.

The body may be monocrystalline. The surface may be at a crystallographic plane of the body. The body may be a natural or synthetic crystal. The body may be a film formed by a deposition process. The body may be diamond or cubic boron nitride.

Alternatively, the body may be polycrystalline.

In another aspect, the invention provides a tool having a surface for engaging the workpiece to cut or abrade the workpiece, the tool surface having at least one abrasive element as aforesaid for engaging the workpiece.

There may be a plurality of abrasive elements for engaging the workpiece. The plurality of abrasive elements may be aligned to cause the cutting elements of each abrasive element to engage a workpiece, in use, with substantially the same orientation relative to the workpiece.

In a further aspect, the invention provides a method of forming an abrasive element, in which a body of crystalline abrasive material is provided, the body having a surface, in which an array of cutting elements is formed in the surface as projections of the crystalline abrasive material at the surface of the body.

The cutting elements may be arranged as a regular array. A plurality of the cutting elements may be formed as a line of cutting elements in the array. A plurality of the cutting elements may be formed with at least one face or edge with the same orientation in each cutting element. Each of the plurality of cutting elements may be formed with substantially the same shape. There may be a further plurality of cutting elements within the array formed with a different form. There may be one or more further arrays of cutting elements formed as projections of the crystalline abrasive material at the or a surface of the body.

At least some of the projections may be formed by removing material from the surface. Material may be removed along lines, to leave projections. Material may be removed along lines of a plurality of orientations. Material may be removed over areas, to leave projections. Material may be removed by multiple operations, and with the orientation of the body being changed between operations. Material may be removed by ablation of the surface to leave the cutting elements as projections from the surface. The ablation may be achieved by laser illumination or by an ion beam.

At least some of the projections may be formed to be parallelepipedal, prismatic, cylindrical, pyramidal or frustum in form. At least some of the projections may be formed to have planar tops, which may be parallel with or inclined relative to the surface of the body. At least some of the planar tops may be polygonal. At least some of the projections may have curved tops. The projections may have surfaces which meet the surface of the body at an obtuse or acute angle. The projections may have surfaces which meet at edges, at obtuse or acute angles. At least some of the cutting elements within at least one of the arrays protrude from the surface by the same amount as each other.

The array may include a line of projections formed in alignment along a crystallographic plane. The array may include a group of projections which each have a face or edge along a crystallographic plane.

The body may have a plurality of faces in which arrays of cutting elements are formed as aforesaid. The body may be monocrystalline. The surface may be at a crystallographic plane of the body. The body may be a natural or synthetic crystal. The body may be a film formed by a deposition process. The body may be diamond or cubic boron nitride.

Alternatively, the body may be polycrystalline.

Examples of the present invention will now be described in more detail, by way of example only, and with reference to the accompanying drawings, in which.

Figure 1:
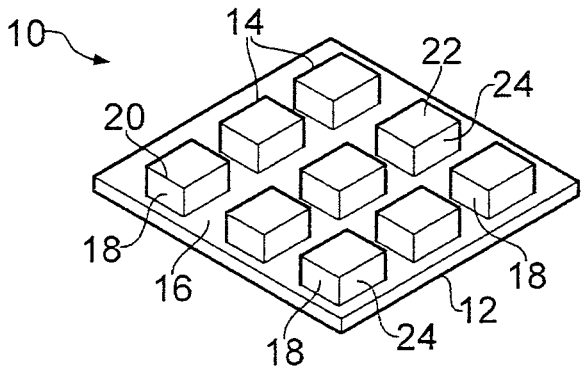
FIGS. 1 to 5 are schematic perspective views of tool elements which are examples of one aspect of the invention.

FIG. 1 illustrates a tool element 10 comprising a body 12 of crystalline abrasive material. The body 12 has an array of cutting elements 14 formed as projections of the crystalline abrasive material at a surface 16 of the body. The body 12 may be a natural or synthetic crystal. The body 12 may be a film formed by a deposition process, such as chemical vapour deposition. The body may be diamond or cubic boron nitride.

In this example, the cutting elements 14 are arranged as a regular array. That is, the cutting elements 14 are positioned across the surface 16 to form a square grid. A plurality of the cutting elements 14 form lines of cutting elements in the array, there being several parallel lines of cutting elements 14 in each of two perpendicular directions. In this example, all of the cutting elements 14 have one face 18 and one edge 20 with the same orientation in each projection. That is, each of the faces 18 is parallel with each other face 18, and each edge 20 is parallel with each other edge 20. In addition, in this example, each of the edges 20 lies within the plane of one of the faces 18.

Figure 2:
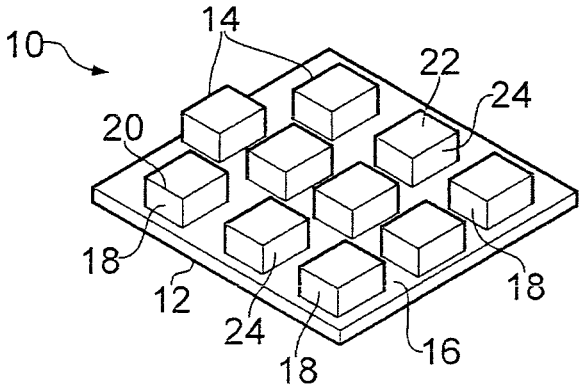

FIG. 2 illustrates an alternative arrangement in which the sole difference arises from a different geometry for the array. In the alternative of FIG. 2, the cutting elements 14 are not aligned in a square grid. The cutting elements 14 form straight, parallel lines in one direction, and a set of parallel diagonal lines.

Many other geometries could be chosen for the array of cutting elements 14, according to the performance required of the abrasive tool for which the tool element 10 is to be used.

Figure 3:
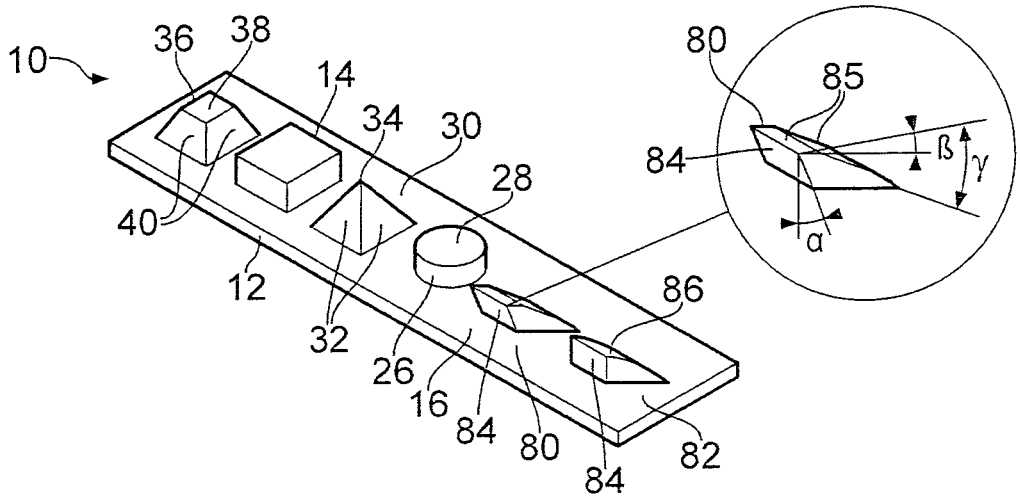

In the examples of FIG. 1 and FIG. 2, all of the cutting elements 14 are parallelepipedal. Each has a square flat (planar) top 22 and four rectangular side faces 18, 24. Other geometries could be used for the cutting elements 14. Examples are illustrated in FIG. 3. In FIG. 3, a parallelepipedal cutting element 14 as shown in FIG. 1 and FIG. 2 is again illustrated for comparison purposes. Another example cutting element 26 has the form of a right circular cylinder with an axis perpendicular to the surface 16. The cutting element 26 has a flat (planar) top 28, which is circular and is parallel with the surface 16. Another example cutting element 30 is in the form of a pyramid having four triangular faces 32. The pyramid element 30 finishes at a point 34. Another example cutting element 36 is in the form of a frustum. In this example, the element 36 is a pyramid frustum having a flat (planar) top 38 which is square and bounded by four parallelogram faces 40. The flat top 38 is illustrated as parallel with the surface 16, but other orientations could be used. Further example cutting elements 80, 82 are prismatic, having side faces 84 which may meet the surface 16 at obtuse, acute or perpendicular angles. The top of the cutting element 80 is illustrated as multi-faceted, in which case, each facet 85 meets neighbouring facets 85 at edges, which may define obtuse or acute angles, or right angles, illustrated by the angles $\alpha$, $\beta$, $\gamma$ in the enlarged detail of FIG. 3. The top 86 of the cutting element 82 is illustrated as curved. Thus, FIG. 3 illustrates that the projections 14, 26, 30, 36 may be parallelepipedal, prismatic, cylindrical, pyramidal or frustum in form. At least some of the projections 14, 26, 36 may have flat tops 22, 28, 38. At least some of the flat tops 22, 38 may be polygonal.

Consideration of FIGS. 1, 2 and 3 also indicates that each of the plurality of projections 14, 26, 30, 36 may have substantially the same shape, as in the examples of FIG. 1 and FIG. 2 or alternatively, there may be a mixture of shapes, as in the example of FIG. 3. Thus, in addition to a plurality of projections of one shape, there may be a further plurality of projections having a different shape, size or form. These may form part of a single array (with projections of different shapes, sizes or forms intermingled with each other), or there may be more than one array formed on a single body, each array having either a single shape, size or form of projection, or multiple shapes, sizes or forms intermingled with each other.

Figure 4:
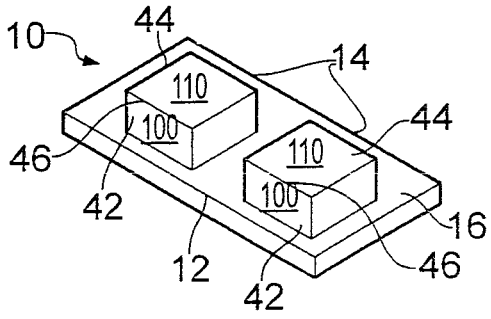
Figure 5:
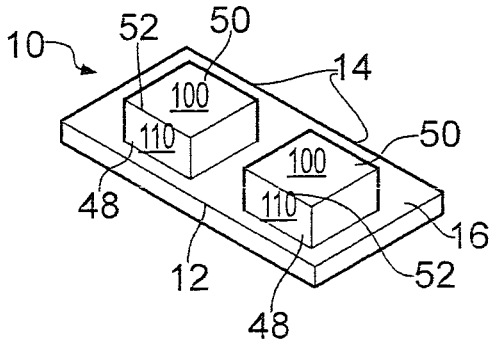

The body 12 has been described as a crystalline material. Particular advantages are expected to arise by making use of the crystalline nature of the body 12. Examples are illustrated in FIG. 4 and FIG. 5. In FIG. 4, the body 12 is monocrystalline. Parallelepipedal cutting elements 14 are provided, similar to those of FIG. 1 and FIG. 2. However, the position and orientation of the elements 14 is chosen so that the elements form a line which is aligned along a crystallographic plane of the monocrystal. That is, side faces 42 are aligned with the 100 plane of the monocrystal. The flat top 44 is therefore aligned with the 110 plane of the monocrystal. The elements 14 therefore also have edges 46 which are aligned along the 100 plane and the 110 plane of the monocrystal.

In FIG. 5, the body 12 is again monocrystalline. Parallelepipedal cutting elements 14 are provided, similar to those of FIG. 1 and FIG. 2. In this example, the position and orientation of the elements 14 is again chosen so that the elements form a line which is aligned along a crystallographic plane of the monocrystal. In this example, side faces 48 are aligned with the 110 plane of the monocrystal. The flat top 50 is therefore aligned with the 100 plane of the monocrystal. The elements 14 therefore also have edges 52 which are aligned along the 100 plane and the 110 plane of the monocrystal.

In both the examples of FIG. 4 and FIG. 5, the surface 16 is parallel with the flat tops 44, 50 and is therefore also aligned with the 110 and 100 planes, respectively. Other crystallographic orientations for the tops 44, 50, and the surface 16, could be used.

In other examples, polycrystalline bodies 12 can be used.

Figure 6:
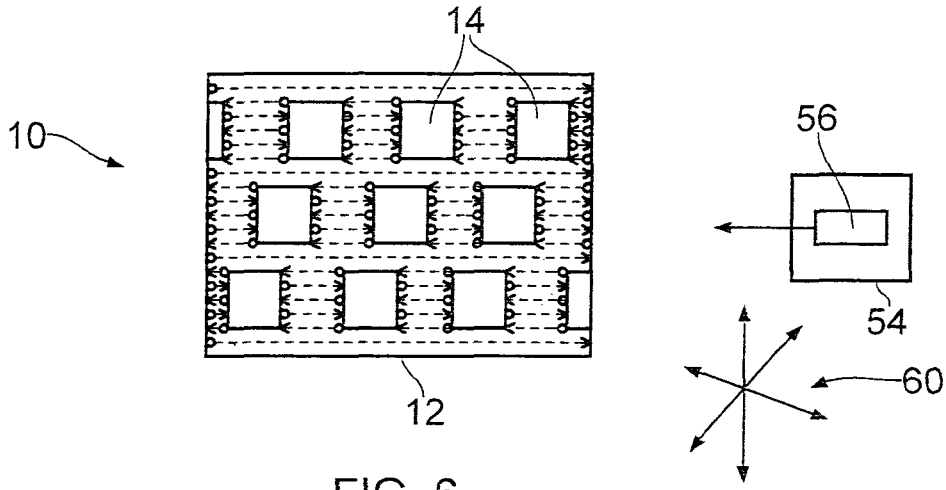
FIGS. 6 to 8 illustrate a manufacturing method for tool elements like those of FIGS. 1 to 5.
Figure 7:
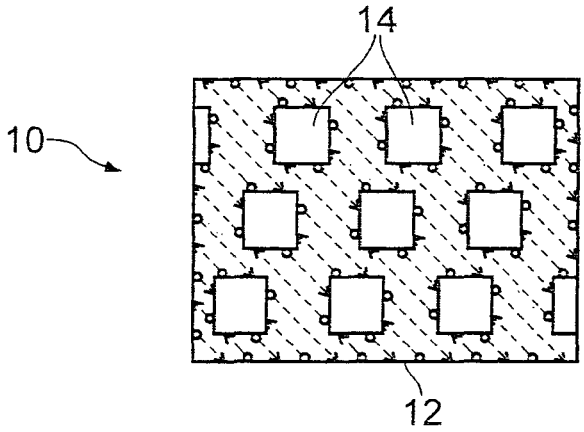
Figure 8:
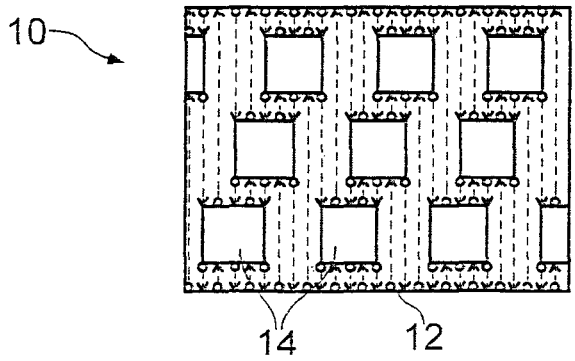

FIGS. 6, 7 and 8 illustrate in simple diagrammatic form an example of a process for forming tool elements 10, of the type described above.

A laser machining centre indicated at 54 (FIG. 6 only) may be used. The laser system 54 is equipped with a Nd:YAG Q-switched pulse laser 56 (wavelength 1064 nm; 100 W max. output power; 50 kHz max. pulse frequency; focal point size 40 μm) mounted on linear stages (indicated by arrows 60) to provide multi-axis movement relative to the body 12. The laser 56 is used for ablating (or milling or etching) layers of the body 12, for the formation of arrays of cutting elements of the type described above. The ablation is executed in one or more stages, each stage creating a plurality of parallel passes across the surface 16. FIG. 6 indicates the passes at a first angle. Broken lines indicate the position of each pass. The laser light is switched off (or blocked from reaching the surface 16) where a cutting element 14 is being formed, and is switched on (or allowed to illuminate the surface 16) elsewhere, to ablate material between the cutting elements 14. The arrowheads and spots shown on the passes in FIG. 6 indicate positions for switching the laser off and on, respectively Procedures such as bruiting, cutting or polishing may be required to prepare the shapes and surfaces of the parent crystal, for example into plates, prior to the production of cutting elements.

FIG. 7 indicates a second sequence of passes (broken lines), at a second angle, here at 45° orientation to the first passes of FIG. 6. Again, the laser light is switched on and off as necessary (spots and arrowheads), to ablate material between the cutting elements 14, leaving the cutting elements 14 to project from the ablated surface 16.

FIG. 8 indicates a third sequence of passes, at a third angle, here at 90° orientation to the first passes of FIG. 6.

In these examples, the projections which form the cutting elements 14 are therefore formed by removing material from the surface of the body 12. In these examples, material is removed along lines, to leave projections, and may be removed along lines of a plurality of orientations.

Figure 9:
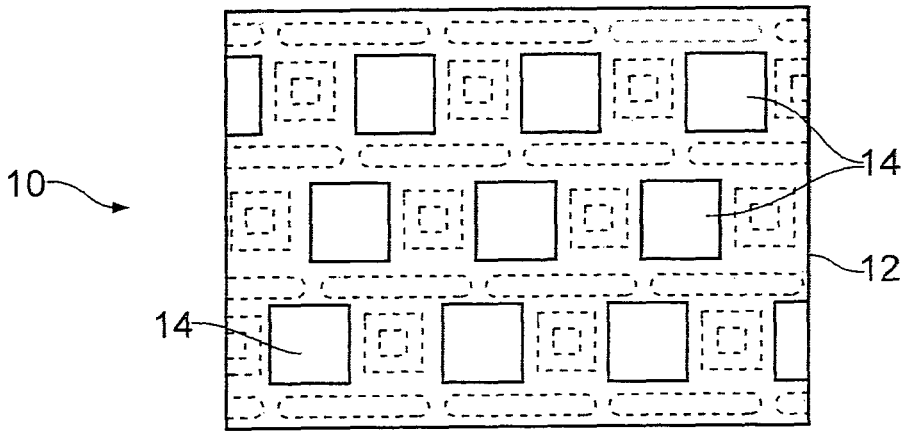
FIG. 9 illustrates an alternative manufacturing method.

In other examples, illustrated in FIG. 9, material may be removed over areas, to leave projections. Thus, FIG. 9 illustrates (in broken lines) various closed loop, spiral or other shapes of paths, used to ablate over areas which are large relative to the width of the ablating beam. These loops and other path shapes have the effect of cutting pockets in the surface of the body 12, leaving the cutting elements 14 as projections between adjacent pockets.

In any of these examples, material may be removed by multiple operations, and with the orientation of the body being changed between operations.

The operating parameters used in executing the laser ablation passes just described, will affect the quality of the tool element created. For example, the depth of the microgrooves formed by the ablation, their continuity along the cut, and the sharpness of cut edges left on the cutting elements 14 are all influenced by the operating parameters. We have found that by varying the laser output power (10-100% of max. power), pulse frequency (f=1-50 kHz) and beam feed speed (v=50-1000 mm per sec), various groove widths (0.040-0.060 mm) and depths (0.010-0.050 mm) can be achieved in polycrystalline diamond test pieces.

Laser ablation of multiple grooves and multiple layers on polycrystalline diamond is expected to provide a rapid method of generating patterns that replicate (at different sizes and orientations) the predominant morphological shapes found on diamond crystal faces. The shapes include squares, triangles and hexagons and their derivatives. Using multiple passes with successive sweeping angles, arrays of different shapes of cutting elements have been produced on polycrystalline diamond structures (5×10×0.5 mm) with ranges of 0.03-0.6 mm and 0.03-0.6 mm, respectively, for the spacing and width of the cutting elements.

We have produced arrays on two types of free standing thick film diamond-based structures (polycrystalline and monocrystalline) in the form of pre-cut logs (0.8×0.8×5 mm). The polycrystalline material has a columnar crystallographic structure while the monocrystalline structure is characterized by either {100} or {110} oriented crystallographic planes on the polished surfaces of the samples. These diamond logs with different crystallographic orientations (polycrystalline and monocrystalline: {100} or {110}) have been produced to be further tested for their cutting efficiency in simulated grinding trials. In each case, the test arrays were produced having identical square cutting elements each measuring 0.1 mm across flats and having a population of 18 cutting elements per square millimeter, with 4 cutting faces per element. This allowed a maximum of eight staggered rows of cutting elements (similar to the arrangement of FIG. 2) to be formed across the 0.8 mm section of the diamond log, being the direction chosen for the ablation passes for this array type.

After laser ablation of mono- or polycrystalline CVD diamond structures, it may be necessary to remove graphite residue from the surfaces. This can be done by immersing the samples in aqua regia (1:3 by volume of nitric acid in hydrochloric acid) for 2 hours, followed by ultrasonic cleaning in deionised water for 15 minutes.

Figure 10:
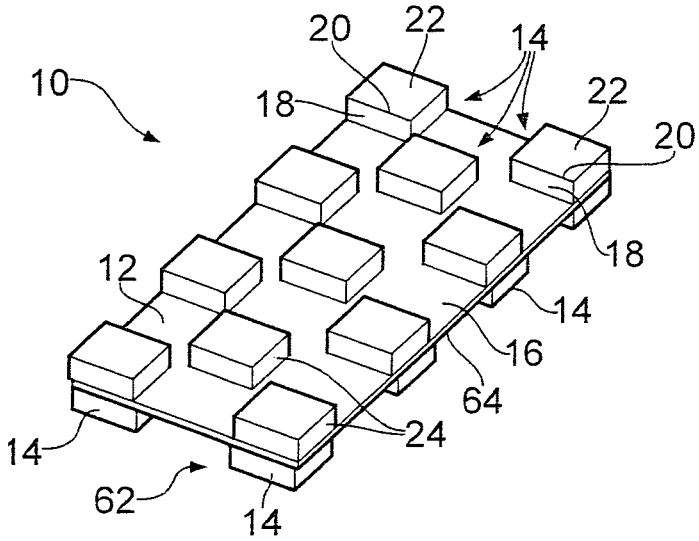
FIG. 10 illustrates a further example tool element.

In each of the examples described above, cutting elements are formed in only a single face. An alternative possibility is illustrated in FIG. 10. Features correspond closely with the features of FIG. 1 and FIG. 2, except that in this example, a second array 62 of cutting elements 14 is formed on a second face 64 of the body 12. The faces 18, 64 are parallel and oppositely directed. Consequently, the various crystallographic orientations described above can be provided for the second array 62.

Figure 11:
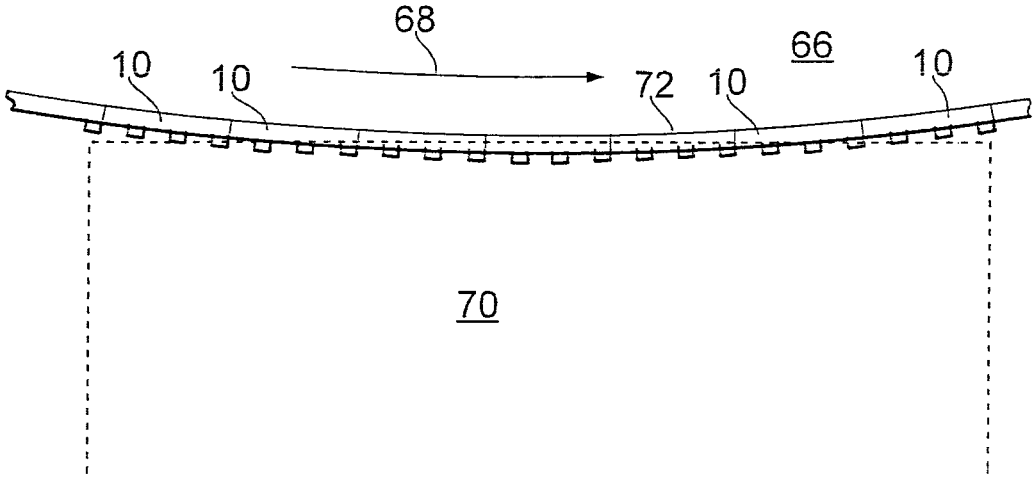
FIG. 11 illustrates tool elements forming part of a grinding tool.

Tool elements such as the examples described above, can be used in the production of abrasive tools, such as grinding and cutting tools, in the manner illustrated in FIG. 11. FIG. 11 illustrates a grinding wheel 66 driven to rotate in the direction of the arrow 68 to grind or cut into a workpiece 70 as the circumference 72 of the wheel 66 passes the workpiece 70. A plurality of tool elements 10 of the type which have been described are mounted around the circumference 72. The elements 10 may be bonded to the wheel 66, or surface set by means of a galvanic or brazing process. The elements are given the reference numeral 10 in FIG. 11, but it is to be understood that any of the other elements described above could alternatively be used. The tool elements 10 sequentially engage the workpiece 70 as they pass, to abrade and cut the workpiece 70. The tool elements 10 can be fixed around the circumference 72 so that as each element 10 passes the workpiece 70, the projections formed on each tool element 10 will engage the workpiece 70 with substantially the same orientation relative to the workpiece 70. This is expected to be particularly advantageous in the event that the tool element 10 is a monocrystalline element with cutting elements aligned with crystallographic planes.

The interconnecting attachments of each cutting elements to one another, by virtue of their formation from a single body of material body, enhances their retention to the tool and reduces premature crystal loss as is experienced with conventional superabrasive tooling. The cutting elements can furthermore be arranged to allow a predetermined number of cutting points to contact the workpiece and provide controlled and regular disposal of waste such as machined chips.

The examples described above allow the formation of arrays of precisely arranged and precisely shaped diamond or cbn cutting elements which protrude by the same amount from the base material, forming tool elements for use in superabrasive tools, either in bonded or in surface set form. When monocrystalline structures allow the use of identical crystallographic orientation, the profile and the spacing of each cutting elements allows its individual performance to be optimised thereby contributing to an improved overall performance of the tool.

The examples described above are expected to provide high performance and high precision cutting or grinding where superabrasives are used. The attributes can be particularly beneficial in miniature or micro tooling where a high degree of control of distribution and crystallographic orientation of the micro cutting edges is desirable in order to achieve the enhanced surface finishes and accuracies of machined parts while improving the reliability/life of the superabrasive tooling.

Many variations and modifications can be made to the particular examples described above, without departing from the scope of the present invention. The examples described above use diamond or cbn modified by laser. Other energy beams (eg. ion beam) streams or jets, or other removal techniques could be used to create shapes and arrays from a larger crystal or a solid film for generating preferentially oriented, shaped and sized tool cutting edges. In one form, cutting elements can be produced by shaping one face of the parent crystal or solid (FIG. 1, for example). This form lends itself particularly to monolayer tools as produced by galvanic or brazed processes. In another form, crystallites can be produced by shaping opposing faces of the parent crystal or solid (FIG. 10). This form could be favoured for bonded tooling where arrays could be set into the bond matrix of the tool. In another form, cutting elements can be produced into all the peripheral faces of the parent crystal and could be mounted on rotary cylindrical tools.

Although the use of polycrystalline material is described above and is expected to provide various advantages, we expect particular advantages to arise from the formation of arrays of cutting elements which are formed from monocrystalline material, such as monocrystalline diamond or cbn, to provide cutting elements on the cutting edges of superabrasive tools. The examples provide the means for producing an array of cutting elements which all have identical crystallographic orientations. In this case, cutting elements will be cut from a face of selected crystallographic orientation and a pattern of cutting elements formed with their defined faces aligned to an adjacent face of the parent crystal or solid with a known crystallographic orientation. This allows each cutting element in an array to be defined having an orientated direction. For example cutting elements may be cut from the face of a parent crystal having [100] orientation and aligned to an adjacent faces on the parent crystal having a [100] orientation.

The cutting elements can be cut into shapes to reflect the occurring shapes defining the crystallographic structure or morphology of the underlying crystal, particularly diamond or cbn. For example, a cutting element can be of rectangular shape when cut from planes of [100] or [110] orientation, or of triangular shape when cut from planes of orientation [111]. Other examples can be envisaged.

Cutting elements can also be cut from multicrystalline material, such as diamond or cbn, of non uniform crystallographic orientation which will produce cutting elements having random crystallographic orientations. This will produce cutting elements of defined shape and spacing offering multifaceted crystalline cutting edges which may be advantageous in, for example the grinding or cutting of sintered materials such as carbides or ceramics.

Depending on the process used to shape the cutting elements from the parent crystal, some finishing procedures could be required to clean the surfaces affected by cutting. In the case of laser cutting for example, brushing using a diamond paste of suitable characteristic could be used to remove thermal effects from the cut faces.

The arrays of cutting elements can be used as produced when mounted to a tool or they can be supported by bond in such a way that the bond provides individual support to each cutting elements. The cutting element arrays can be produced from solid diamond or cbn material or from material which has been prepared with a substrate to provide backing support.

Abrasive elements of the type described may also be useful in tribological applications, for example being designed to provide different frictional properties in different directions.

The extent of the individual cutting element array is determined from the size and characteristics of the parent crystal or solid it is formed from and the requirements of the tool for which the tool element is to be used. The cutting element arrays can either be attached to the surface of a tool or set into a bond as the abrasive elements. Depending on the requirements of the application for the tool, the cutting element arrays can be positioned around the periphery of the tool's cutting or grinding surface in specific locations and orientations to achieve the required abrasive function.

The number of arrays and their orientations used in a tool can be selected according to the application requirements. Larger arrays of cutting elements could be particularly favoured for rough grinding while denser arrays may be beneficial for fine grinding or cutting. Three dimensional arrays may be beneficial for use in micro grinding. In the case of three dimensional arrays, individual arrays can be stacked together and joined to form an abrasive wheel or tool head. In another configuration, three dimensional arrays can consist of cutting elements as the abrasive elements and the interconnecting structure which can also serve as the skeletal structure of the abrasive tool and over which a bond would normally be applied.

The invention claimed is:

1. An abrasive element comprising a monocrystalline body of abrasive material having an array of cutting elements formed as projections of the monocrystalline abrasive material at a surface of the body, the array including a line of projections aligned along a crystallographic plane, wherein at least some of the projections have curved tops.

2. An element according to claim 1, wherein a plurality of the cutting elements have at least one face or edge with the same orientation in each cutting element.

3. An element according to claim 1, wherein at least some of the projections are parallelepipedal, prismatic, cylindrical, pyramidal or frustum in form.

4. An element according to claim 1, wherein at least some of the projections have planar tops.

5. An element according to claim 4, wherein at least some of the planar tops are polygonal.

6. An element according to claim 1, wherein the array includes a group of projections which each have a face or edge along a crystallographic plane.

7. An element according to claim 1, wherein the surface is at a crystallographic plane of the body.

8. An element according to claim 1, the body being diamond or cubic boron nitride.

9. An element according to claim 1, comprising projections between pockets in the surface.

10. An element according to claim 9, wherein pockets form lines between adjacent projections.

11. An element according to claim 9, wherein pockets form lines of a plurality of orientations.

12. An element according to claim 9, wherein pockets form areas between adjacent projections.

13. An element according to claim 1, wherein at least some of the projections have surfaces which meet the surface of the body at an obtuse or acute angle.

14. An element according to claim 1, wherein at least some of the projections have surfaces which meet at edges, at obtuse or acute angles.

15. An element according to claim 1, the body having a plurality of faces in which arrays of cutting elements are formed as projections of the monocrystalline abrasive material.

* * * * *